US006211765B1

(12) United States Patent
Ito et al.

(10) Patent No.: US 6,211,765 B1
(45) **Date of Patent: *Apr. 3, 2001**

(54) COIL DEVICE

(75) Inventors: Shinichiro Ito; Yukiharu Kinoshita, both of Tokyo (JP)

(73) Assignee: TDK Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 08/629,340

(22) Filed: Apr. 8, 1996

Related U.S. Application Data

(63) Continuation of application No. 08/259,153, filed on Jun. 13, 1994, now abandoned, which is a continuation of application No. 07/658,900, filed on Feb. 22, 1991, now abandoned.

(30) Foreign Application Priority Data

| | | |
|---|---|---|
| Feb. 27, 1990 | (JP) | 2-48830 |
| Oct. 2, 1990 | (JP) | 2-264250 |
| Oct. 2, 1990 | (JP) | 2-264252 |

(51) Int. Cl.[7] ..... H01F 17/06; H01F 21/06

(52) U.S. Cl. ..... 336/178; 336/134; 336/83

(58) Field of Search ..... 336/165, 178, 336/83, 134, 183; 335/281, 296, 297; 427/78; 324/116

(56) References Cited

U.S. PATENT DOCUMENTS

| | | | | |
|---|---|---|---|---|
| 3,426,305 | * | 2/1969 | Keble | 336/178 |
| 3,434,085 | * | 3/1969 | Gang | 335/297 |
| 3,566,323 | | 2/1971 | Graf et al. . | |
| 3,787,790 | | 1/1974 | Hull . | |
| 4,197,494 | * | 4/1980 | Van De Werken | 427/78 |
| 4,209,552 | * | 6/1980 | Welch | 324/126 |
| 4,282,567 | | 8/1981 | Voigt . | |
| 4,887,061 | * | 12/1989 | Matsumura | 336/178 |

FOREIGN PATENT DOCUMENTS

| | | | | |
|---|---|---|---|---|
| 518 715 | | 10/1981 | (AU) . | |
| 922 423 | | 1/1955 | (DE) . | |
| 3123006 | * | 1/1983 | (DE) | 336/178 |
| 1 490 564 | | 8/1967 | (FR) . | |
| 53-53850 | | 12/1978 | (JP) . | |
| 55-77115 | | 6/1980 | (JP) . | |
| 57-130402 | | 8/1982 | (JP) . | |
| 60-7448 | | 3/1985 | (JP) . | |

OTHER PUBLICATIONS

Patent Abstracts of Japan, vol. 4, No. 130 (E–25) (612) Sep. 12, 1980, & JP–A–55 83210 (Nippon Denshi K.K.).

* cited by examiner

*Primary Examiner*—Anh Mai
(74) *Attorney, Agent, or Firm*—Armstrong, Westerman, Hattori, McLeland & Naughton, LLP

(57) ABSTRACT

The present invention provides a coil device including magnetic cores having gaps at positions of at least opposing to each other in a magnetic path to be formed and a coil wound to include at least one of said gaps and its improvement consists in the fact that a shape of at least one of the opposing magnetic cores forming; the gaps around which said coil is wound is made as a curve of logarithmic function from its base end to its extreme end and its most extreme end is provided with a gap adjusting flat surface.

With such an arrangement as above, the present invention provides a coil device capable of reducing a leakage magnetic flux generated around the gaps, preventing an abnormal generation of heat of the coil and further preventing a bad influence of noise against a peripheral apparatus.

11 Claims, 10 Drawing Sheets

COIL DEVICE

This application is a continuation of application Ser. No. 08/259,153 filed Jun. 13, 1994, now abandoned, which was a continuation of Ser. No. 07/658,900, filed Feb. 22, 1991, now abandoned.

BACKGROUND OF THE INVENTION

1. Field of the Invention

The present invention relates to improvements in a coil device for use in a flyback transformer, a switching power transformer, a choke coil or the like and more particularly it relates to improvements in a coil device employing a magnetic core with a gap.

2. Description of the Prior Art

In any of the conventional transformers, choke coils and so forth known heretofore, it is customary to form a gap in a closed magnetic path so that the magnetic core thereof is not saturated when a desired current is caused to flow. For example, when a ferrite magnetic core usually having a magnetic permeability $\mu$ of 5000 or so is used in a transformer, a gap is formed there to reduce the effective permeability $\mu$ within a range of 50 to 300.

This signifies that a gap having a great magnetic reluctance needs to be existence in a ferrite magnetic core of which magnetic reluctance is originally small, wherein a great leakage flux is generated in the periphery of the gap.

It is generally known that such leakage flux exerts at least two harmful influences as follows.

(1) Noise is induced in peripheral apparatus (components) which are prone to be effected by magnetic induction.

(2) In case the coil is so wound as to surround the gap, there occurs abnormal generation of heat in the coil around the gap due to the leakage flux.

For the purpose of solving the above problems, a variety of improvements have been developed.

In an attempt to settle the problem (1) above, there is contrived a coil device 1' of forming a gap merely in the coil alone. In FIG. 17 is illustrated a structure of this conventional type of coil device 1'.

This coil device 1' is constructed such that a sectionally U-shaped first magnetic core 2' is combined with a similarly sectionally U-shaped second magnetic core 3' and then a coil 6' is wound around portions of the magnetic cores 2' and 3'.

The first magnetic 2' and the second magnetic core 3' have legs 2*a*' and 3*a*', respectively. The first magnetic core 2' and the second magnetic core 3' are arranged such hat the first leg 2*a*' and the first leg 3*a*' are oppositely faced to each other via a gap 5'. The coil 6' is wound so as to cover the gap 5' within it. The opposing legs 2*a*' and 3*a*' are formed into such a shape as one in which their lateral sectional areas become equal to each other over their entire lengths. As a combination of the magnetic cores, there may be another sectionally E-shaped core.

A B–H curve shown in FIG. 18 shows a data found in the prior art coil device 1'. As shown in this figure, a maximum flux density Bm of the conventional type of coil device 1' is 5510 Gs.

Table 1 below indicates a result of measurement of temperatures in a coil center X, a coil end Y, a core Z and a periphery W of the conventional type of the coil device 1' measured by a testing device T' shown in FIG. 16B (Test condition: Frequency 80 kHz, Sine wave of 1.0A and Ambient temperature of 40° C.).

TABLE 1

| | (° C.) | | | |
|---|---|---|---|---|
| Structure | X Coil center | Y Coil end | Z Core | W Periphery |
| Prior Art | 107.5 | 79.0 | 74.5 | 44.0 |

As indicated in Table 1, a mere arrangement of the gap 5' only in the coil 6' causes a high temperature of more than 100° C. at the coil center X and further the problem (2) above is expanded more.

As regards the problem (2) above, as already disclosed in Japanese Patent Laid-Open No. 55-77115 and Japanese Utility Model Laid-Open No. 57-130402, this problem is resolved by a method wherein the gap placed within the coil is divided magnetically into a series of plural segments so as to disperse a concentration of leakage magnetic flux. In addition, there are Japanese Utility Model Publication No. 53-53850 and Japanese Utility Model Publication No. 60-7448 in order to resolve the problems (1) and (2) above. These utility models use material as a gap filler of a material having a large specific permeability than that of air (more than 1), reduce magnetic reluctance at the gap and further decrease the leakage magnetic flux.

As described above, in case that the material quality having a greater relative permeability than that of air (more than 1) is arranged within the coil as the gap member, there is a possibility that the problems (1) and (2) above can be improved to a certain degree.

However, even in this case, there remains a problem that a leakage magnetic flux may be concentrated at an interface part between the gap and the magnetic core. In addition, there is a new problem that it is hard to get such material as one in which it has an appropriate permeability as the gap filling material, a high saturated magnetic flux density and a low magnetic core loss characteristic corresponding to the magnetic core. Due to this fact, this system may generate the following new problem. Namely, the coil wound over the interface part between the gap and the magnetic core may generate heat abnormally. In addition, the gap may also generate heat abnormally due to the loss of magnetic core at the gap filling material. Further, the B–H curve of the magnetic core having the gap filling material therein becomes non-linear form and if this is used in a transformer, it may produce a deformed wave form. This is the present state that a more effective improvement may not be attained.

It is therefore an object of the present invention to provide a coil device capable of resolving the aforesaid problems, reducing influence of noise against the peripheral apparatus (component), reducing a leakage magnetic flux generated around the gap and preventing an abnormal generation of heat in the coil. It is another object of the present invention to provide a coil device whose cost is less expensive and its reliability in operation is improved.

SUMMARY OF THE INVENTION

In order to accomplish the aforesaid objects, the present invention provides a coil device having magnetic cores having gaps at positions opposed to each other at least in a formed magnetic path and a coil wound to include at least one of said gaps characterized in that a shape of at least one of the opposing magnetic cores to form the gaps around which said coil is wound is made as a curve of logarithmic function ranging from its base end part to its extreme end and its extreme end is provided with a flat surface for adjusting the gaps.

The aforesaid magnetic cores may be formed by combining the U-shaped cores or E-shaped cores.

With such an arrangement, no concentration of the leakage magnetic flux is generated at the interface part between the gaps and the end surface of the magnetic core and further no gap filler material is used, resulting in that the magnetic core loss is not produced and the aforesaid objects can be accomplished.

BRIEF DESCRIPTION OF THE DRAWINGS

FIG. 16(*b*) is an illustrative view for showing a method for measuring a temperature at each of the portions in a coil device of the prior art.

DESCRIPTION OF THE PREFERRED EMBODIMENTS

Figure 1A:
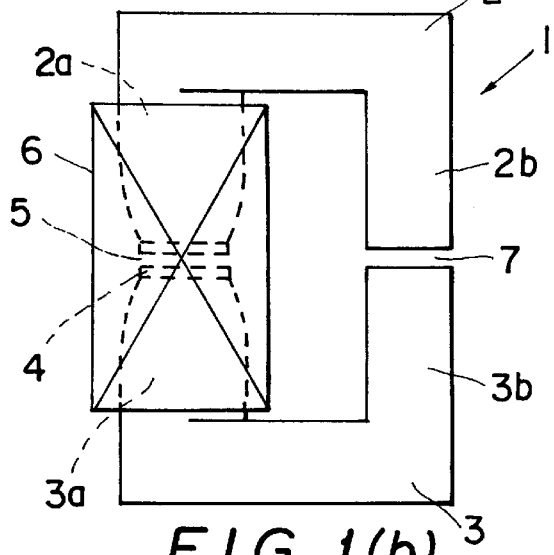
FIGS. 1(*a*) and (*b*) are a schematic view and a top plan view for showing a first preferred embodiment of the present invention.

Referring now to the drawings, some preferred embodiments of the present invention will be described.

Figure 1B:
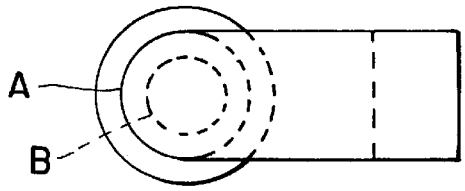

The coil device 1 of the first preferred embodiment shown in FIGS. 1(*a*) and (*b*) is constructed such that the sectionally U-shaped first magnetic core 2 is combined with the similarly sectionally U-shaped second magnetic core 3 and then a coil 6 is wound around a part of the magnetic cores 2 and 3.

The first magnetic core 2 has a first leg part 2*a* and a second leg part 2*b*. The second magnetic core 3 has a first leg part 3*a* and a second lag part 3*b*. The first and second magnetic cores 2 and 3 are arranged such that each of the first leg 2*a*, the first leg 3*a*, the second leg 2*b* and the second leg 3*b* is oppositely faced to each other through gaps 5 and 7, respectively.

The coil 6 is wound so as to cover one of the gaps 5 in it. The first magnetic core 2 and the second magnetic core 3 are made of ferrite, for example.

Figure 2:
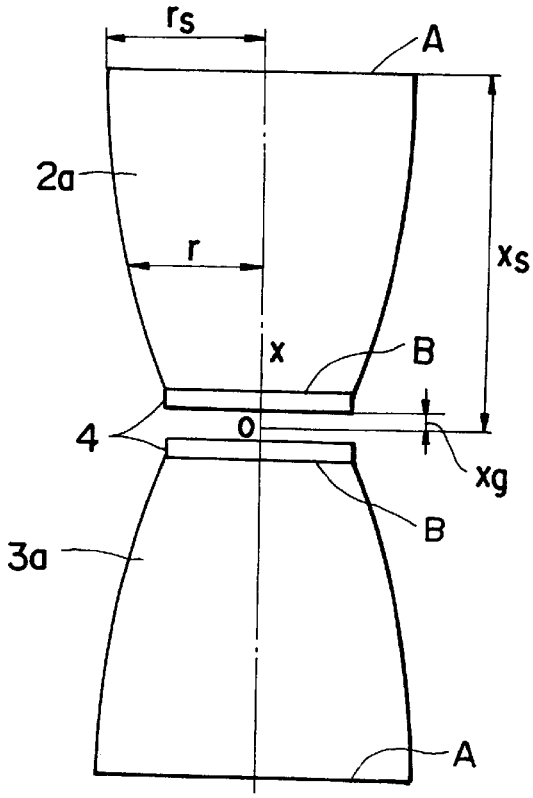
FIG. 2 shows a shape of leg forming a gap shown in FIG. 1(*a*).

As shown in FIG. 2, a shape of each of the opposing first leg 2*a* and the first leg 3*a* around which the coil 6 is wound is formed such that a lateral sectional area of an extreme end B is smaller than a lateral sectional area of a base end A and further it has a curved shape given by a logarithmic function. Such a shape of the extreme end can be expressed by the logarithmic function of the following equation.

$$r_s - r = x_g l_n(X_s/x)$$

where, x: distance from a center O of the gap 5 toward central axes of the legs 2*a* and 3*a* r: distance from the central axes of the legs 2*a* and 3*a* toward a radial direction $r_s$: radius of a base end A of legs 2*a* and 3*a*

$X_s$: distance from the base end A to the center O of the gap 5

$x_g$: distance from the extreme end B to the center O of the gap 5

The extreme end B of each of the opposing first legs 2*a* and 3*a* around which the coil 6 is wound is provided with a core member 4 having a flat surface as shown in FIG. 2. The core member 4 is used for shaving partially the flat surface in parallel when the gap 5 between the legs 2*a* and 3*a* is to be be adjusted. Even if this flat surface is partially shaved, an area at the extreme end surface is not varied, resulting in that a characteristic of the device is not varied and its adjustment can be carried out. The core member 4 is made of ferrite, for example.

Figure 3A:
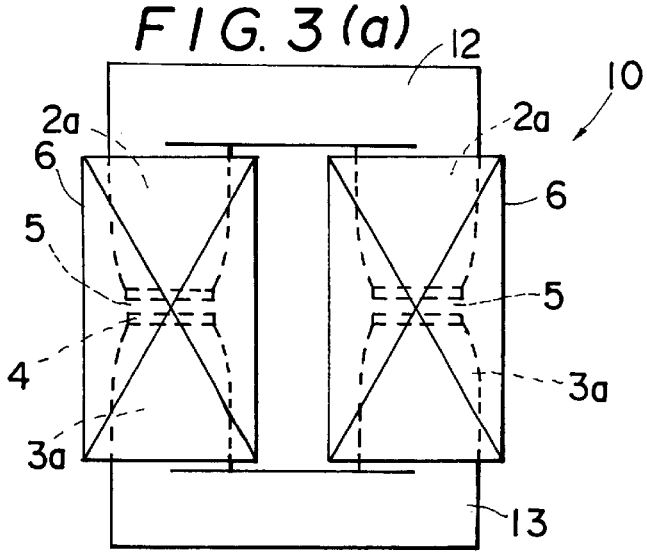
FIGS. 3(*a*) and (*b*) are a schematic view and a top plan view for showing a coil device of a second preferred embodiment of the present invention.
Figure 3B:
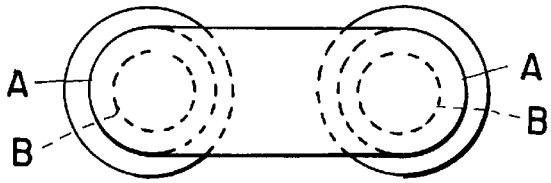

The coil device 10 of the second preferred embodiment shown in FIGS. 3(*a*) and (*b*) is constructed such that the sectionally U-shaped first magnetic core 12 is combined with the similarly sectionally U-shaped second magnetic core 13 and the coils 6 are wound around a part of the magnetic cores 12 and 13.

The first magnetic core 12 has two first legs 2*a* of the first preferred embodiment device 1, and the second magnetic core 13 has two first legs 3*a* of the first preferred embodiment device 1. Each of the magnetic cores 12 and 13 is arranged so as to be opposed to each other via the gap 5 in the same manner as that of the first preferred embodiment device 1. The coil 6 is wound in such a way as each of the gaps 5 is covered in it.

Figure 4A:
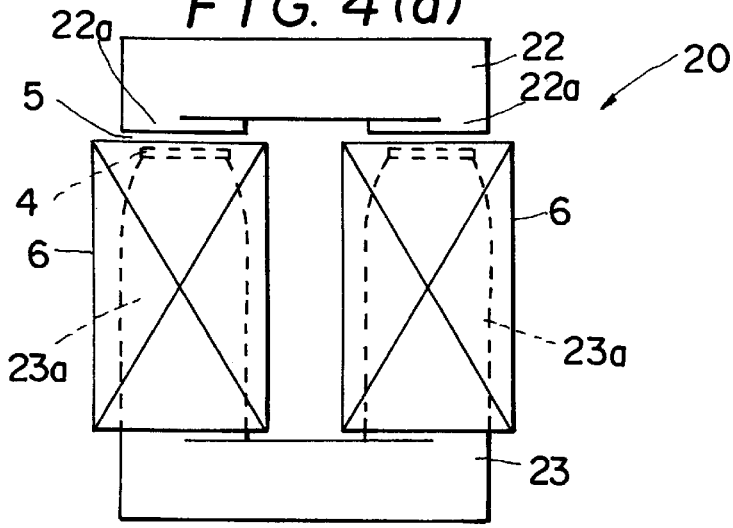
FIGS. 4(*a*) and (*b*) illustrate a schematic view and a top plan view of a coil device of a third preferred embodiment of the present invention.
Figure 4B:
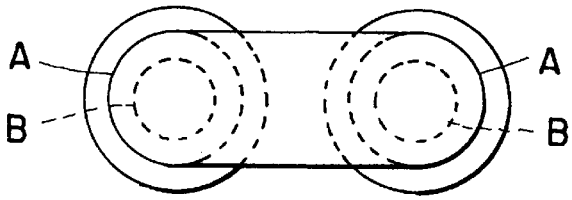

The coil device 20 of the third preferred embodiment of the present invention shown in FIG. 4 is constructed such that the substantially sectionally U-shaped first magnetic core 22 approximating to a flat plate is combined with the sectionally U-shaped second magnetic core 23 and then the coils 6 are wound around a part of the magnetic core 23.

The first magnetic core 22 has two slight projecting ends 22*a* and the second magnetic core 23 has the first two legs

23*a* having the similar shape as that of the first preferred embodiment device 1. The first and the second magnetic cores 22 and 23 are constructed such that each of the ends 22*a* and each of the first legs 23*a* are oppositely faced to each other via gaps 5. The coils 6 are wound around each of the first legs 23*a* so as to partially cover each of the gaps 5 therein.

Figure 5:
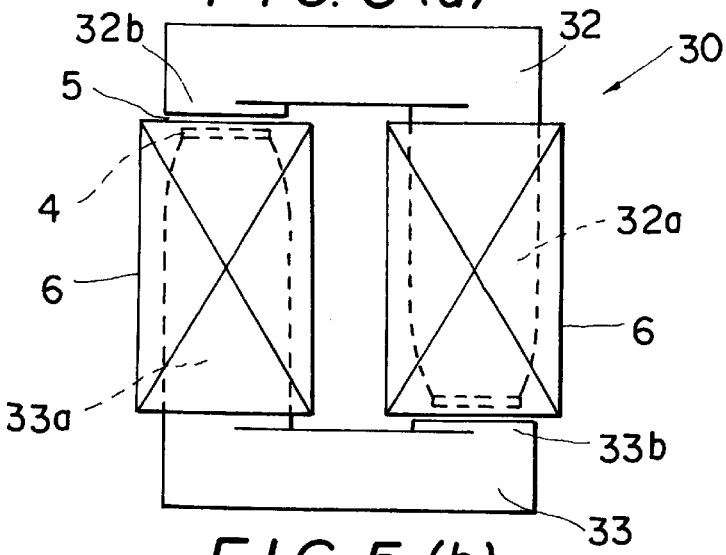
FIGS. 5(*a*) and (*b*) illustrate a schematic view and a top plan view for showing a coil device of a fourth preferred embodiment of the present invention.
Figure 5:
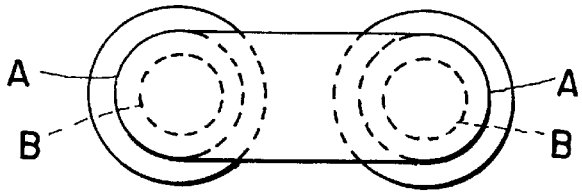

The coil device 30 of the fourth preferred embodiment of the present invention shown in FIG. 5 is constructed such that the substantially sectionally U-shaped first magnetic core 32 similar to an L-shape is combined with the substantially sectionally U-shaped second magnetic core 33 similar to an L-shape and the coils 6 are wound around a part of each of the magnetic cores 32 and 33.

The first magnetic core 32 has a slight projecting end part 32*b* and the first leg 32*a,* and the second magnetic core 33 has a slight projecting end 33*b* and the first leg 33*a*. The first and the second magnetic cores 32 and 33 are constructed such that each of the end part 32*b* and the first leg 33*a,* and each of the end part 33*b* and the first leg 32*a* are oppositely arranged to each other via gaps 5. The coils 6 are wound around each of the first legs 32*a* and 33*a* to cover each of the gaps 5 partially within them. Each of the legs 32*a* and 33*a* is similarly constructed as that of the legs 2*a* and 3*a* of the coil device 1 shown in FIG. 1.

Figure 6:
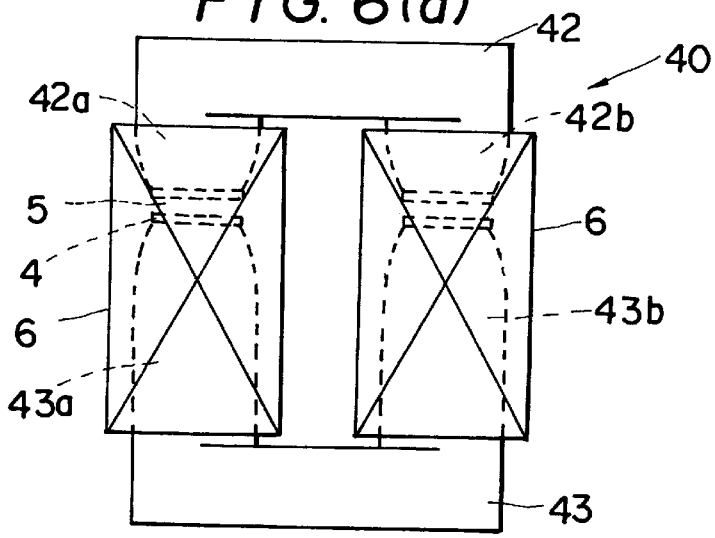
FIGS. 6(*a*) and (*b*) illustrate a schematic view and a top plan view for showing a coil device of a fourth preferred embodiment of the present invention.
Figure 6:
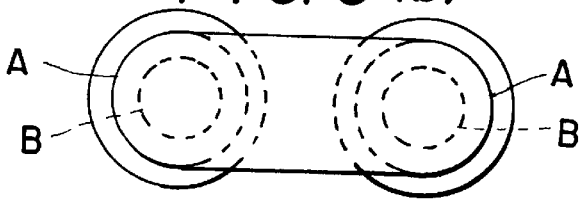

The coil device 40 of the fifth preferred embodiment of the present invention shown in FIG. 6 is constructed such that the sectionally U-shaped first magnetic core 42 is combined with the sectionally U-shaped second magnetic core 43 and the coils 6 are wound around a part of the magnetic cores 42 and 43.

The first magnetic core 42 has the first leg 42*a* and the second leg 42*b*. The second magnetic core 43 has the first leg 43*a* and the second leg 43*b* longer than the leg 42*a* and the leg 42*b* of the first magnetic core 42. The first magnetic core 42 and the second magnetic core 43 are constructed such that each of the first leg 42*a* and the first leg 43*a,* and each of the second leg 42*b* and the second leg 43*b* are oppositely faced to each other via gaps 5. The coils 6 are wound to cover each of the gaps 5 in them. Each of the legs 42*a,* 42*b,* 43*a* and 43*b* is similarly constructed as that of the legs 2*a* and 3*a* of the coil device 1 shown in FIG. 1.

Figure 7:
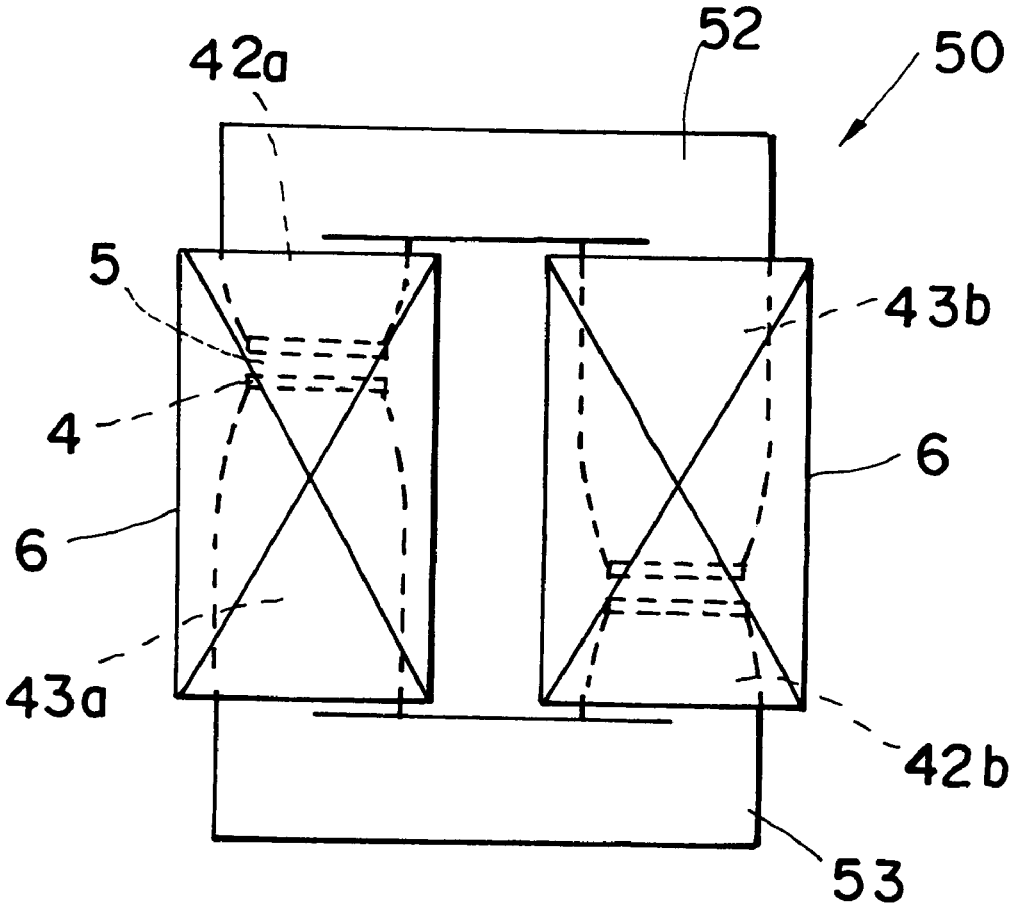
FIGS. 7(*a*) and (*b*) illustrate a schematic view and a top plan view for showing a coil device of a sixth preferred embodiment of the present invention.
Figure 7:
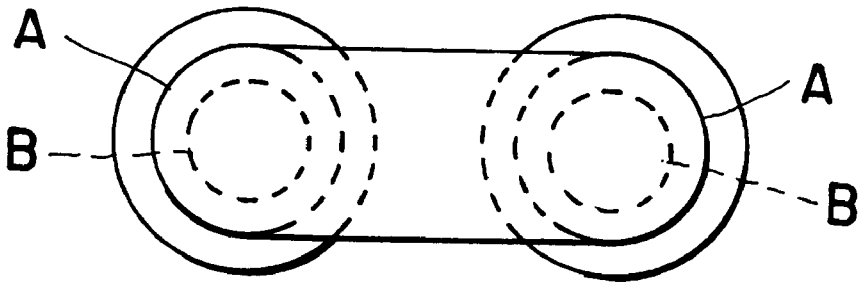

The coil device 50 of the sixth preferred embodiment of the present invention shown in FIG. 7 is constructed such that the legs 42*b* and 43*b* shown in FIG. 6 are replaced and then the first magnetic core 52 of substantial U-shaped section similar to an L-shape is combined with the second magnetic core 53 of U-shaped section also similar to an L-shape.

Figure 8:
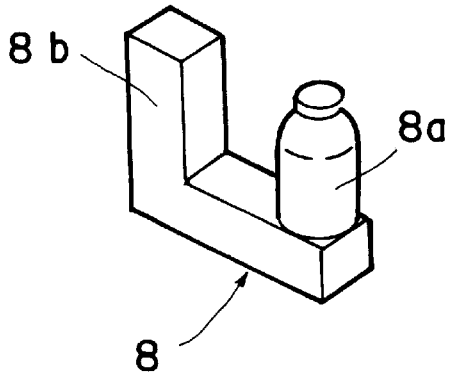
FIGS. 8(*a*) and 8(*b*) and FIG. 9 are perspective views for showing legs of the device shown in FIGS. 1 and 3 to 7, respectively.
Figure 8:
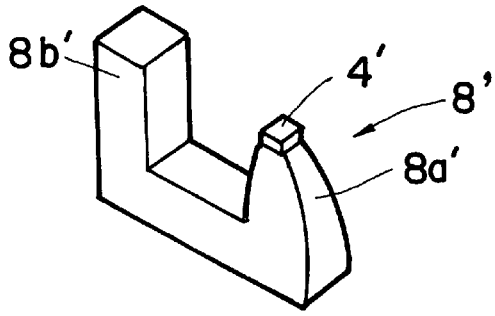

As the aforesaid sectionally U-shaped magnetic core, the magnetic cores shown in FIGS. 8(*a*), 8(*b*) and 9 are used.

Figure 9:
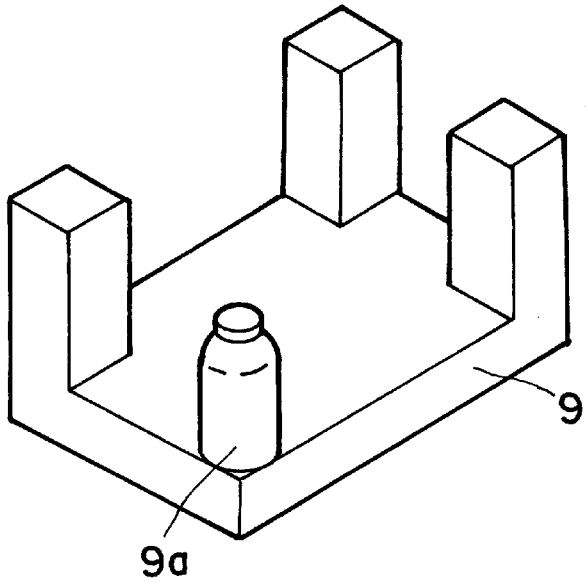

The magnetic core 8 shown in FIG. 8(*a*) is made such that a leg 8*b* of the magnetic core having no coil 6 wound thereonaround is made into a square shape and the other leg 8*a* is formed into a column. A magnetic core 8' shown in FIG. 8(*b*) is made such that both legs 8*a*' and 8*b*' are made into square shapes and a gap adjusting core member 4' of the leg 8*a*' around which the coil 6 is wound is formed into a square shape. The magnetic core 9 shown in FIG. 9 is made such that U-shaped square magnetic cores are connected in parallel to each other and one leg 9*a* is formed into a column. Both of them show a U-shaped section. A practical device is made such that the coils 6 are wound around the column-like legs 8*a,* 9*a* or the square leg 8*a*' while each of the legs having this shape is coupled in pairs, respectively, and each of the figures above shows only one side core. Material for these magnetic cores is ferrite, for example.

Figure 10:
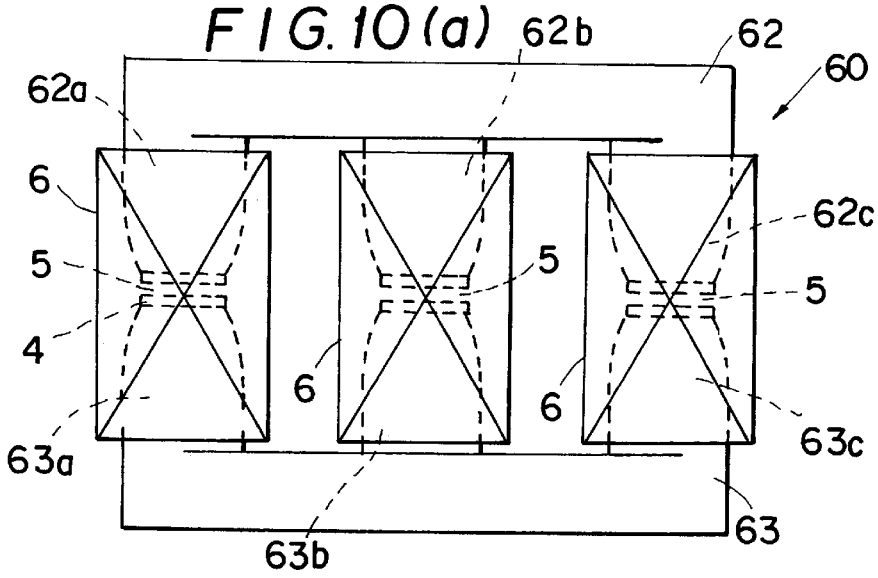
FIGS. 10(*a*) and (*b*) illustrate a schematic view and a top plan view for showing a coil device of a seventh preferred embodiment of the present invention.
Figure 10:
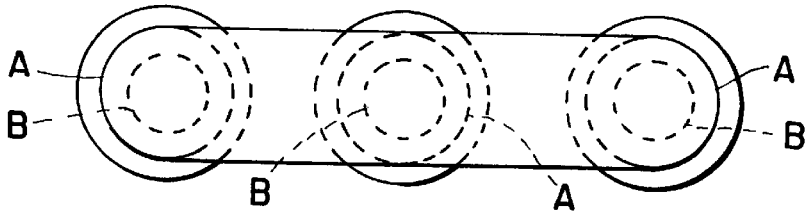

The coil device 60 of the seventh preferred embodiment of the present invention shown in FIG. 10 is constructed such that the magnetic cores 12 and 13 of the device 10 shown in FIG. 3 are formed into an E-shape. This device 60 is made such that the sectionally E-shaped first magnetic core 62 is coupled with the similarly sectionally E-shaped second magnetic core 63 and the coils 6 are wound around a part of the magnetic cores 62 and 63.

The first magnetic core 62 has the first, second and third legs 62*a,* 62*b* and 62*c,* and the second magnetic core 63 has the first, second and third legs 63*a,* 63*b* and 63*c*. The first and second magnetic cores 62 and 63 are constructed such that the first leg 62*a* and the first leg 63*a,* the second leg 62*b* and the second leg 63*b,* and the third leg 62*c* and the third leg 63*c* are oppositely faced to each other via gaps 5, respectively. The coils 6 are wound to cover each of the gaps 5 therein. The legs 62*a* to 62*c* and 63*a* to 63*c* are similarly constructed as the legs 2*a* and 3*a* of the coil device 1 shown in FIG. 1.

Figure 11:
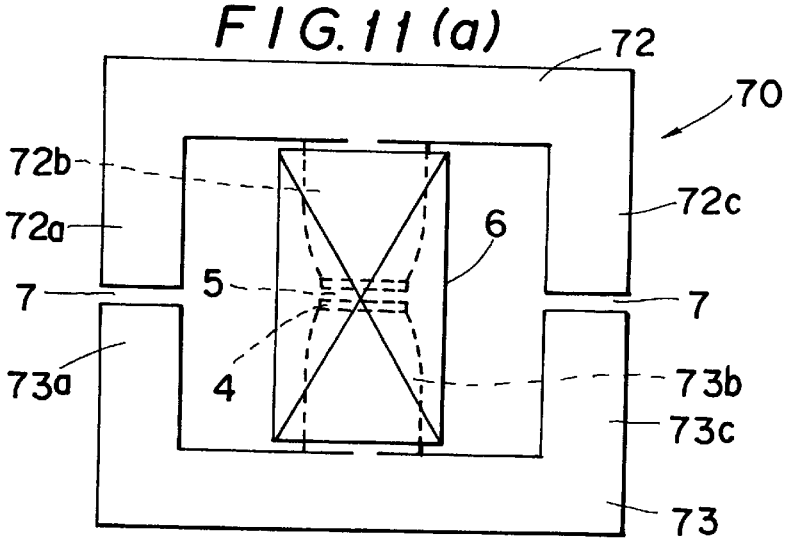
FIGS. 11(*a*) and (*b*) illustrate a schematic view and a top plan view for showing a coil device of an eighth preferred embodiment of the present invention.
Figure 11:
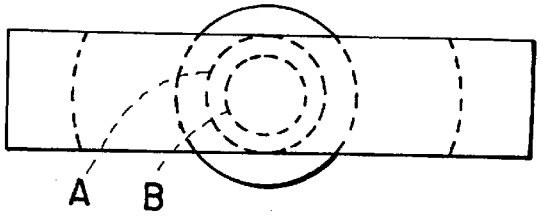

The coil device 70 of the eighth preferred embodiment of the present invention shown in FIG. 11 is made such that the magnetic cores 2 and 3 of the coil device 1 shown in FIG. 1 are formed into an E-shape. The device 70 is constructed such that the sectionally E-shaped first magnetic core 72 is combined to the second magnetic core 73, and the coil 6 is wound around a part of the magnetic cores 72 and 73.

The first magnetic core 72 has the first, second and third legs 72*a,* 72*b* and 72*c*. The first magnetic core 73 has the first, the second and the third legs 73*a,* 73*b* and 73*c*. The first and the second magnetic cores 72 and 73 are arranged such that the first leg 72*a* and the first leg 73*a,* the second leg 72*b* and the second leg 73*b,* and the third leg 72*c* and the third leg 73*c* are oppositely faced to each other via gaps 5 and 7, respectively. The coil 6 is wound so as to cover the central gap 5 therein. Each of the central legs 72*b* and 73*b* is similarly constructed as the legs 2*a* and 3*a* of the coil device 1 shown in FIG. 1.

Figure 12:
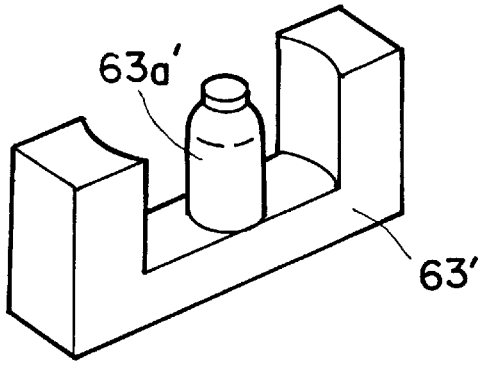
FIGS. 12 to 14 are perspective views for showing examples of leg portions in the device shown in FIGS. 10 and 11.
Figure 13:
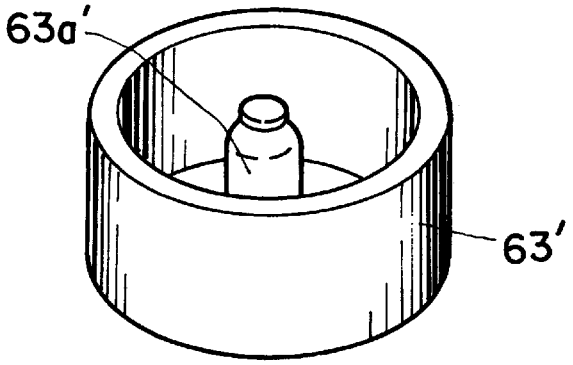
Figure 14:
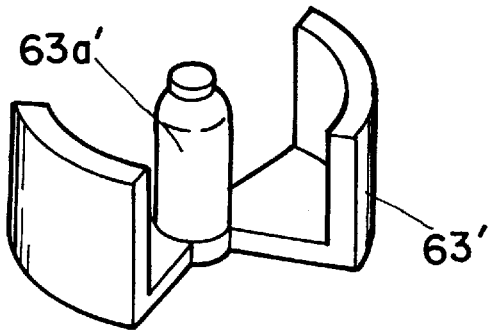

As the aforesaid sectionally E-shaped magnetic core, the magnetic cores shown in FIGS. 12 to 14 are used. That is, the magnetic core shown in FIG. 12 is made such that a magnetic core 63' is formed into an E-shape and a central leg 63*a*' is formed into a column. The magnetic core shown in FIG. 13 is called as a pot-type core 63' in which a column-like leg 63' is formed at a central part of a cylinder having a bottom part. The magnetic core shown in FIG. 14 is made such that a part of the cylinder of the pot-type core shown in FIG. 13 is cut. Any of them has an E-shaped section. Although the practical magnetic cores are combined to each other in pairs and then a coil 6 is wound around the central leg 63*a*', each of the above figures shows only one core. As the material for these magnetic cores, for example, a ferrite is applied.

Figure 16:
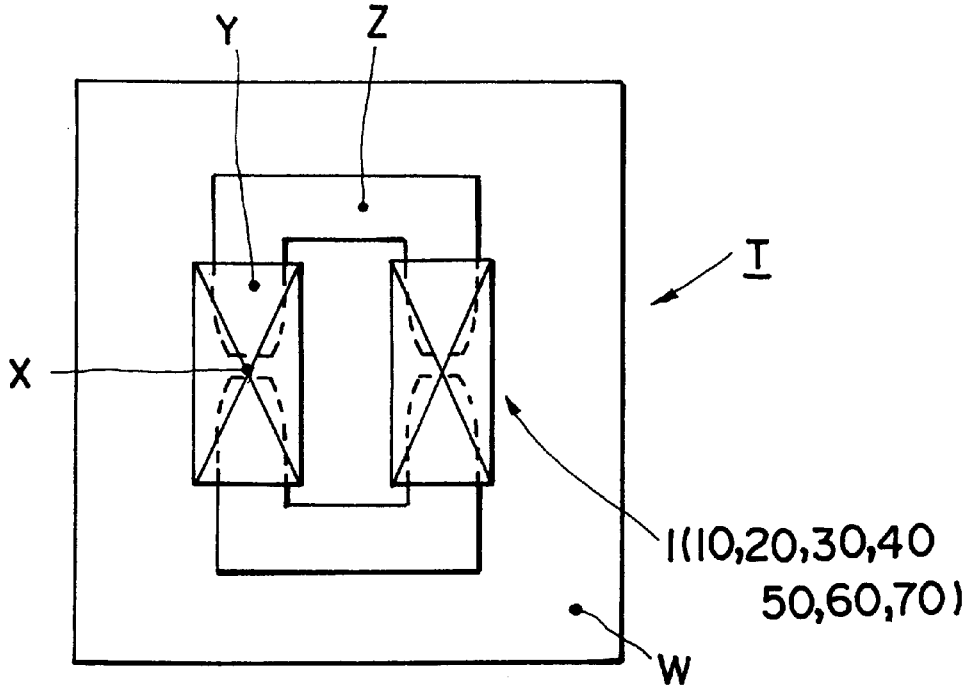
FIG. 16(*a*) is an illustrative view for showing a method for measuring a temperature at each of the portions in a coil device of the present invention.
Figure 16:
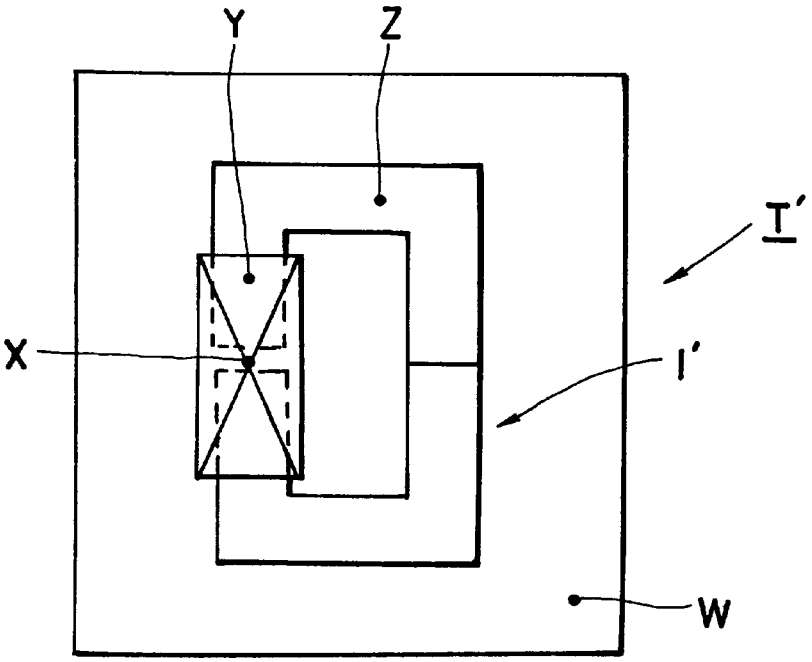
Figure 17:
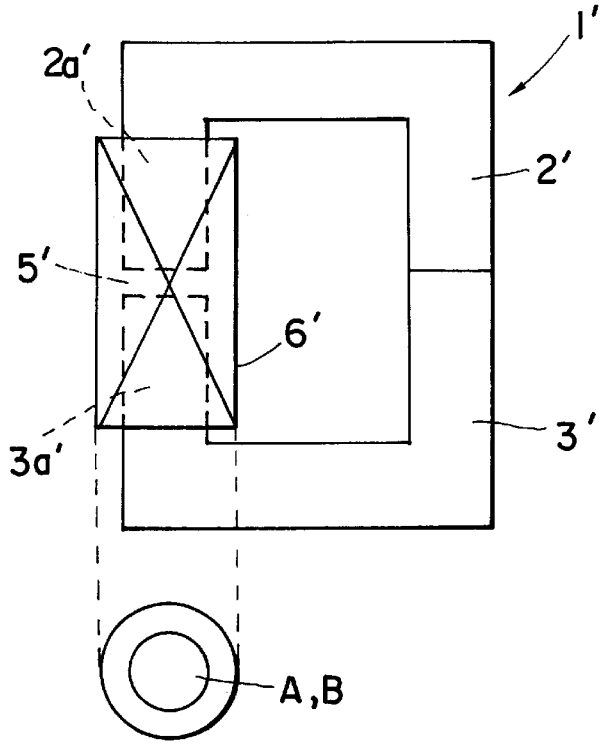
FIG. 17 is a schematic view and a top plan view for showing an example of the prior art.
Figure 18:
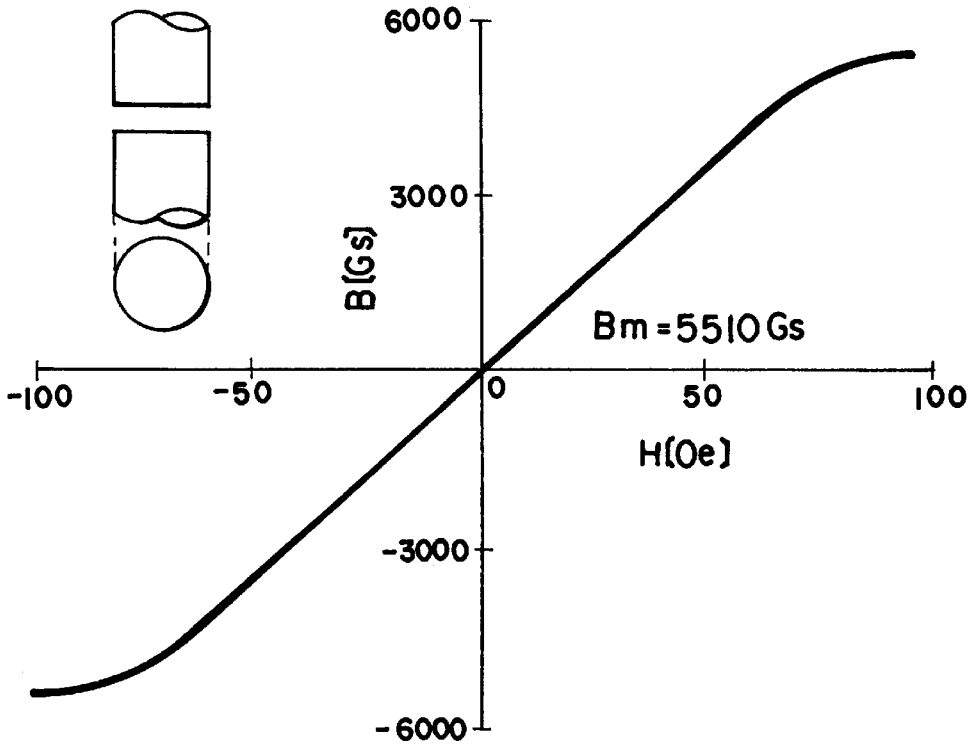
FIG. 18 is a B–H curve diagram for a coil device of the prior art.

Table 2 indicates a result of temperature measurement in each of the portions in the coil device produced by each of the preferred embodiments through a comparison with the prior art coil device 1'. The temperature measurement at each of the portions was carried out by using the testing device T shown in FIG. 16(*a*). (Test condition: Frequency of 80 kHz, 1.0A, Sine wave, Ambient temperature of 40° C.)

TABLE 2

| Structure | X Coil center (° C.) | Y Coil end (° C.) | Z Core (° C.) | W Periphery (° C.) |
|---|---|---|---|---|
| 1st Preferred Embodiment | 62.0 | 55.0 | 53.5 | 41.0 |
| 2nd Preferred Embodiment | 62.1 | 54.9 | 53.7 | 41.0 |
| 3rd Preferred Embodiment | 57.0 | 60.0 | 50.5 | 41.9 |
| 4th Preferred Embodiment | 56.5 | 61.5 | 52.0 | 41.0 |
| 5th Preferred Embodiment | 58.2 | 59.1 | 50.7 | 41.0 |
| 6th Preferred Embodiment | 57.2 | 60.3 | 51.2 | 41.0 |
| 7th Preferred Embodiment | 61.6 | 55.8 | 53.8 | 41.0 |
| 8th Preferred Embodiment | 61.5 | 56.0 | 53.7 | 41.0 |
| Prior Art | 107.5 | 79.0 | 74.5 | 44.0 |

As apparent from Table 2 above, according to each of the preferred embodiments of the present invention, it is acknowledged that temperatures at the coil center X, coil end Y, core Z and periphery W are lowered than that of the prior art. Accordingly, it is possible to prevent an abnormal generation of heat of the coil. That is, it means that the leakage magnetic flux produced around the gap having the coil wound therearound is reduced. Accordingly, it is further possible to prevent a bad influence of noise against the peripheral apparatus. In addition, the assembling operation may easily be carried out, resulting in that a cost reduction of the device can be attained.

Figure 15:
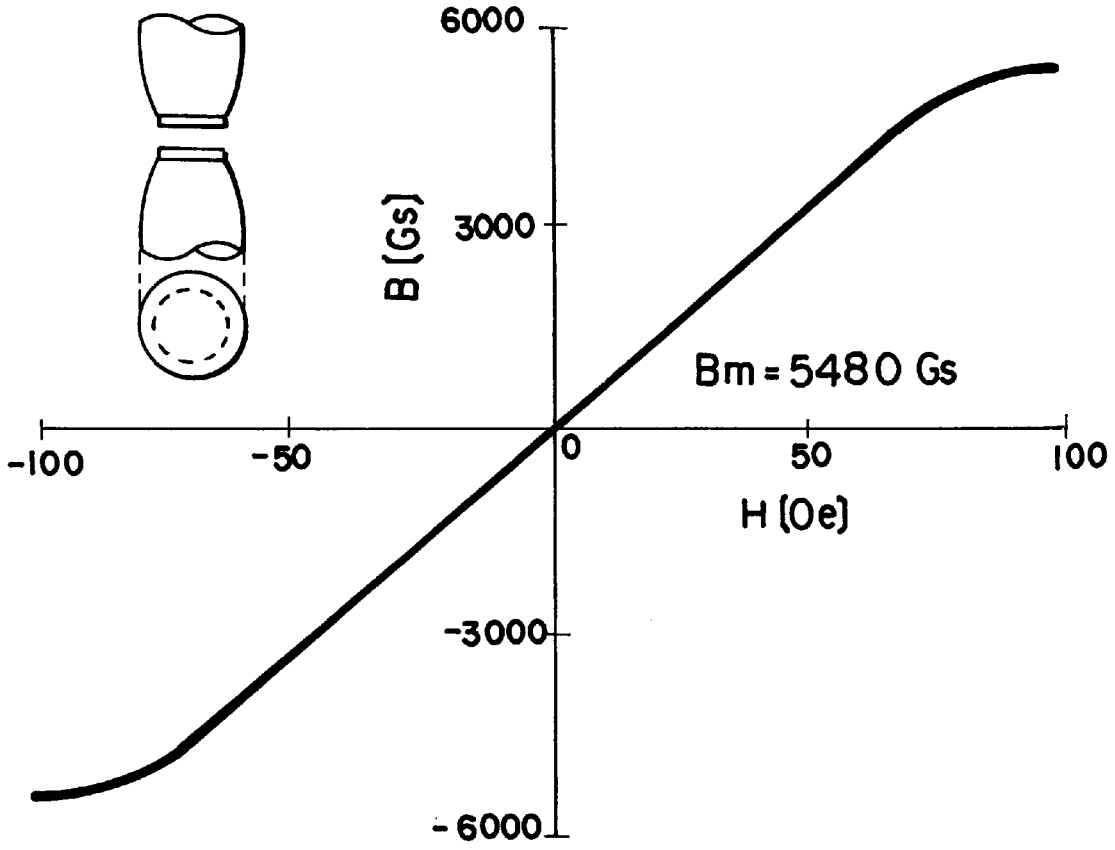
FIG. 15 is a B–H curve diagram for a coil device of the present invention.

It is further apparent that although the maximum magnetic flux density Bm of the coil device in each of the preferred embodiments of the present invention was 5510 Gs in the prior art as shown in the B–H curve in FIG. 15, this value is slightly decreased to 5480 Gs and its linear characteristic is not varied. Since the area keeping its linear characteristic is almost invariant, there is no obstacle in practical operation even if the density Bm is decreased to such a value as above.

What is claimed is:

1. A coil device comprising:

a plurality of magnetic cores constituting a magnetic path;

at least one gap being provided between said plurality of magnetic cores; and at least one coil being wound around said gap; wherein said gap is formed between two ends of said plurality of magnetic cores;

each of said two ends of said plurality of magnetic cores has a form of a curve of a logarithmic function from a base end to an extreme end; and said extreme end is provided with a gap adjusting projection facing the other of said two ends of said plurality of magnetic cores to thereby form said gap.

2. The coil device of claim 1, wherein said gap adjusting projection is made of the same material as that of said plurality of magnetic cores.

3. The coil device of claim 1, wherein said gap adjusting projection has a uniform cross section.

4. The coil device of claim 1, wherein said magnetic cores are coupled U-shaped cores.

5. The coil device of claim 1, wherein the cross section of one of said magnetic cores and the cross section of said gap adjusting projection are circular.

6. The coil device of claim 1, wherein said magnetic cores are both provided with gap adjusting projections where said magnetic cores face each other.

7. The coil device of claim 1, wherein said core having one end formed by a curve of logarithmic function is a solid integral homogenous column of ferrite.

8. A transformer including the coil device of claim 1.

9. A choke coil including the coil device of claim 1.

10. The coil device of claim 1, wherein said magnetic cores are made of ferrite.

11. The coil device of claim 10, wherein said magnetic cores made of ferrite are comprised of compression molded ferrite.

* * * * *